US007726031B1

(12) United States Patent
Gibbs

(10) Patent No.: US 7,726,031 B1
(45) Date of Patent: Jun. 1, 2010

(54) KNIFE SYSTEM

(76) Inventor: Douglas P. Gibbs, 779 Shasta St., Yuba City, CA (US) 95991

( * ) Notice: Subject to any disclaimer, the term of this patent is extended or adjusted under 35 U.S.C. 154(b) by 419 days.

(21) Appl. No.: 11/745,849

(22) Filed: May 8, 2007

Related U.S. Application Data

(60) Provisional application No. 60/801,220, filed on May 17, 2006.

(51) Int. Cl.
*B26B 1/10* (2006.01)

(52) U.S. Cl. ..... 30/335; 30/151; 30/337; 279/57

(58) Field of Classification Search ..... 30/151, 30/167, 168, 169, 329, 335–340; 279/2.02, 279/2.03, 2.04, 2.1, 2.18, 46.1, 47–53, 57, 279/63–65

See application file for complete search history.

(56) References Cited

U.S. PATENT DOCUMENTS

| | | | | | |
|---|---|---|---|---|---|
| 1,694,558 | A | * | 12/1928 | O'Flaherty | 279/65 |
| 2,439,071 | A | * | 4/1948 | Basham | 279/77 |
| 2,530,713 | A | * | 11/1950 | Martinez | 269/6 |
| 2,619,724 | A | * | 12/1952 | Manthey et al. | 30/336 |
| 3,518,993 | A | * | 7/1970 | Blake | 606/142 |
| 3,549,159 | A | * | 12/1970 | Kroener | 279/53 |
| 3,636,997 | A | * | 1/1972 | Keymer | 30/513 |
| 3,927,893 | A | * | 12/1975 | Dillon et al. | 279/75 |
| 3,977,079 | A | * | 8/1976 | Rebold | 30/336 |
| 4,039,178 | A | * | 8/1977 | Odames | 269/75 |
| 4,071,952 | A | * | 2/1978 | Meshulam et al. | 30/151 |
| 4,094,497 | A | * | 6/1978 | Stratton | 269/71 |
| 4,294,013 | A | * | 10/1981 | Krieg | 30/392 |
| 4,508,328 | A | * | 4/1985 | Kojima | 269/236 |
| 5,727,319 | A | * | 3/1998 | Myerchin et al. | 30/123 |
| 6,101,726 | A | * | 8/2000 | Laverick | 30/392 |
| 7,596,871 | B1 | * | 10/2009 | Nilsson | 30/329 |
| 2004/0226175 | A1 | * | 11/2004 | Ping | 30/340 |

OTHER PUBLICATIONS

Ehobbytools.Com, Hobby Knives, website <available at http://www.ehobbytools.com/en-us/dept_22.html>, 14 pgs.
Wikipedia, X-Acto Knife, website <available at http://en.wikipedia.org/wiki/X-Acto_knife>, 1 pg.

* cited by examiner

*Primary Examiner*—Boyer D. Ashley
*Assistant Examiner*—Edward Landrum
(74) *Attorney, Agent, or Firm*—Neustel Law Offices

(57) ABSTRACT

A knife system for providing efficient replacement of a knife blade. The knife system generally includes a body, a lever pivotally connected to the body, a collet connected to the body, and a shaft connected between the lever and the collet. When the lever is in a closed position, the shaft applies tension to the collet resulting in frictional engagement with a blade within the collet. An illuminating unit is preferably positioned within the body directing light towards the blade within the collet to illuminate a work area.

17 Claims, 8 Drawing Sheets

KNIFE SYSTEM

CROSS REFERENCE TO RELATED APPLICATIONS

I hereby claim benefit under Title 35, United States Code, Section 119(e) of U.S. provisional patent application Ser. No. 60/801,220 filed May 17, 2006. The 60/801,220 application is currently pending. The 60/801,220 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to knives and more specifically it relates to a knife system for providing efficient replacement of a knife blade.

2. Description of the Related Art

Any discussion of the prior art throughout the specification should in no way be considered as an admission that such prior art is widely known or forms part of common general knowledge in the field.

Utility knives and hobby knives have been in use for years. Conventional utility knives, such as drywall knives, utilize replaceable blades that require removing a portion of the housing to replace the blade. Inexpensive utility knives utilize extendable blades that have breakable segments to allow for a sharpened segment to be exposed from the body. Hobby knives, such as X-ACTO® brand knives, utilize a blade that is mounted in an elongated cylindrical body by a knurled collar that tightens a collet that retains the blade.

A problem with conventional knives is that they are time consuming and cumbersome to replace a blade. A problem with conventional hobby knives is that they are prone to rolling off tables and other surfaces. A problem with utility knives and hobby knives is that they do not provide an independent light source for a user. Another problem with knives that use replaceable blades is that the blades become loosened over time as they are used making it difficult to be accurate.

BRIEF SUMMARY OF THE INVENTION

The general purpose of the present invention is to provide a knife system that has many of the advantages of the knives mentioned heretofore. The invention generally relates to a knife which includes a body, a lever pivotally connected to the body, a collet connected to the body, and a shaft connected between the lever and the collet. When the lever is in a closed position, the shaft applies tension to the collet resulting in frictional engagement with a blade within the collet. An illuminating unit is preferably positioned within the body directing light towards the blade within the collet to illuminate a work area.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a knife system for providing efficient replacement of a knife blade.

Another object is to provide a knife system that illuminates an area near the blade.

An additional object is to provide a knife system that is comprised of an ergonomic design.

A further object is to provide a knife system that is not cumbersome to utilize. Another object is to provide a knife system that prevents a blade from loosening during usage.

Another object is to provide a knife system that is capable of receiving various types and sizes of replaceable blades.

Another object is to provide a knife system that provides adjustable tension for retaining blades.

Another object is to provide a knife system that allows for various blade positions.

Another object is to provide a knife system that stores at least one replacement blade.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
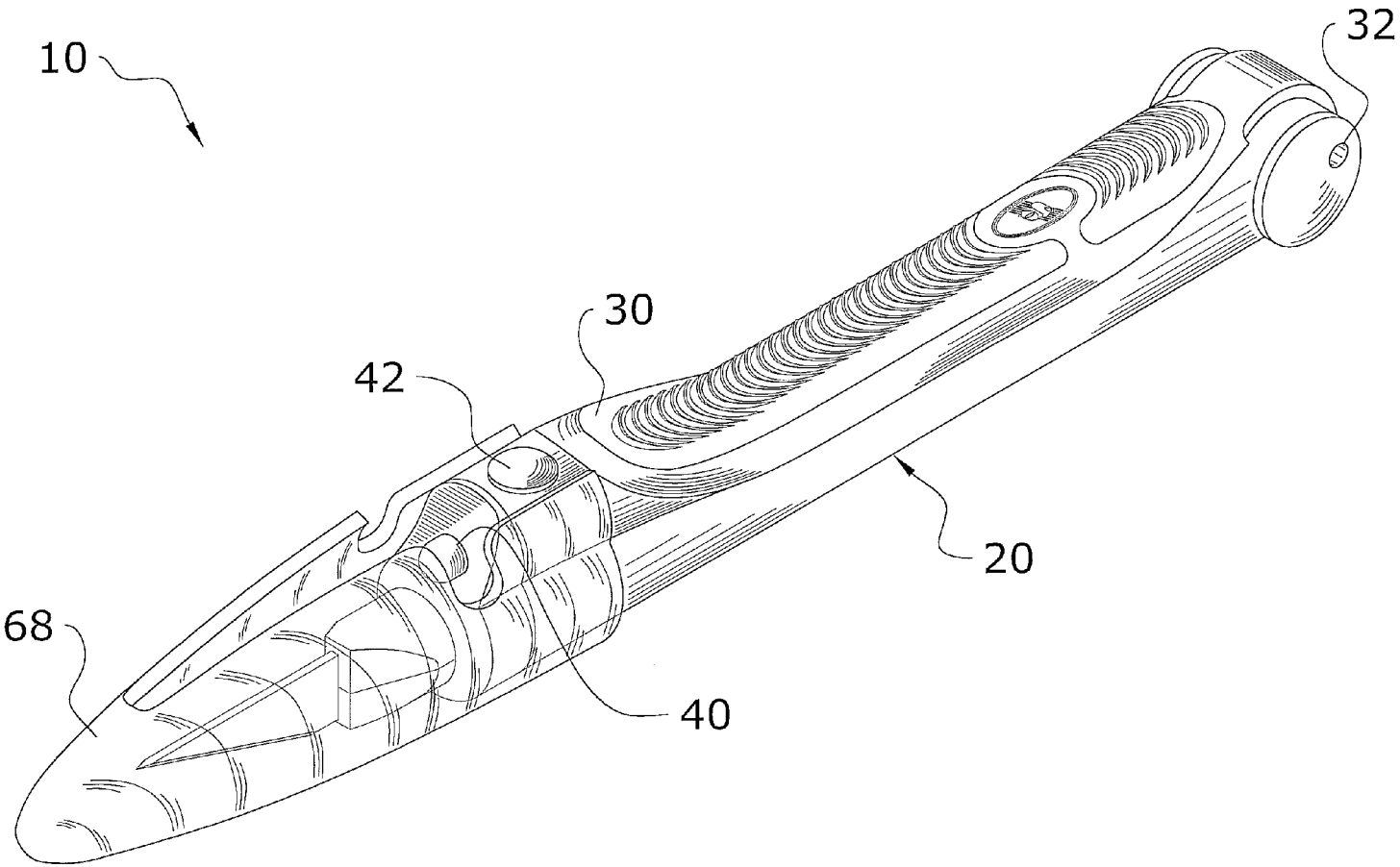
FIG. 1 is an upper perspective view of a preferred embodiment of the present invention.

Turning now descriptively to the drawings, in which similar reference characters denote similar elements throughout the several views, FIGS. 1 through 9 illustrate a knife system 10, which comprises a body 20, a lever 30 pivotally connected to the body 20, a collet 70 connected to the body 20, and a shaft 50 connected between the lever 30 and the collet 70. When the lever 30 is in a closed position, the shaft 50 applies tension to the collet 70 resulting in frictional engagement with a blade 12 within the collet 70. An illuminating unit 40 is preferably positioned within the body 20 directing light towards the blade 12 within the collet 70 to illuminate a work area.

B. Body

FIGS. 1 through 9 illustrate a preferred embodiment for the body 20. The body 20 is preferably comprised of an elongated structure having a first end 21 and a second end 28 opposite of one another. The body 20 is preferably comprised of unitary structure, however, the body 20 may be comprised of multiple components assembled together. The body 20 is preferably comprised of a cast aluminum or other cast material.

Figure 2A:
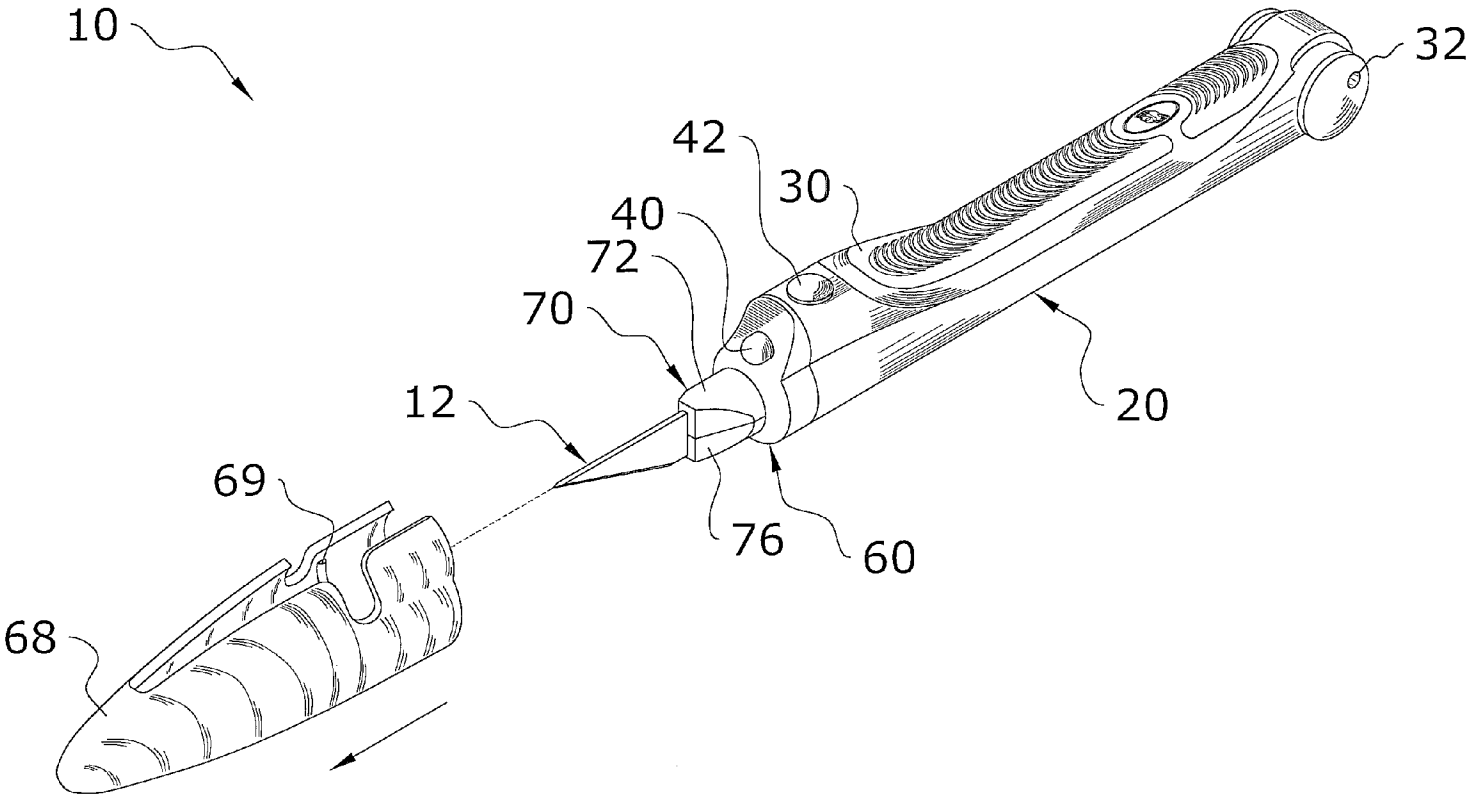
FIG. 2*a* is an upper perspective view of the cap removed.
Figure 2B:
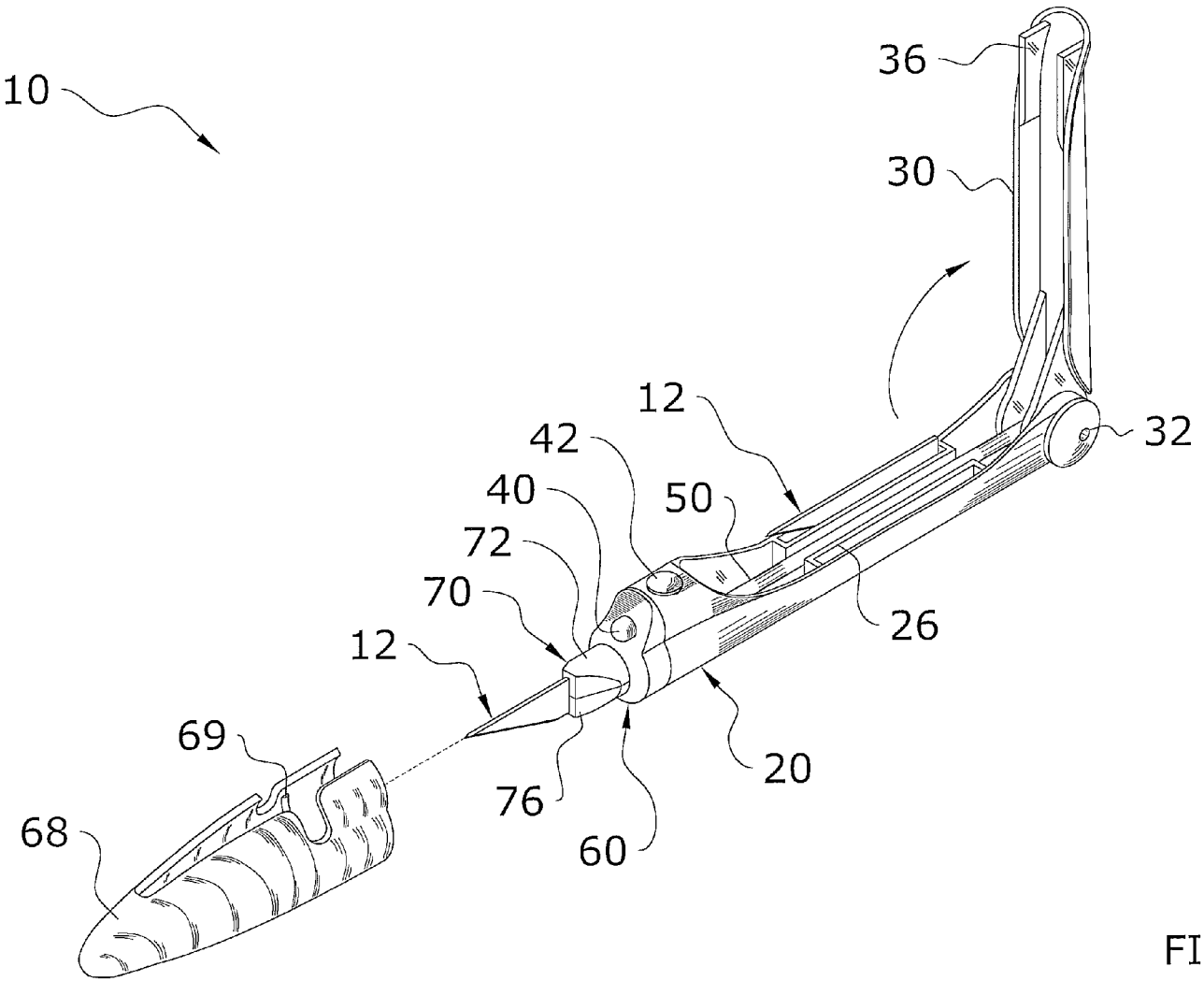
FIG. 2*b* is an upper perspective view of the lever member partially opened.
Figure 2C:
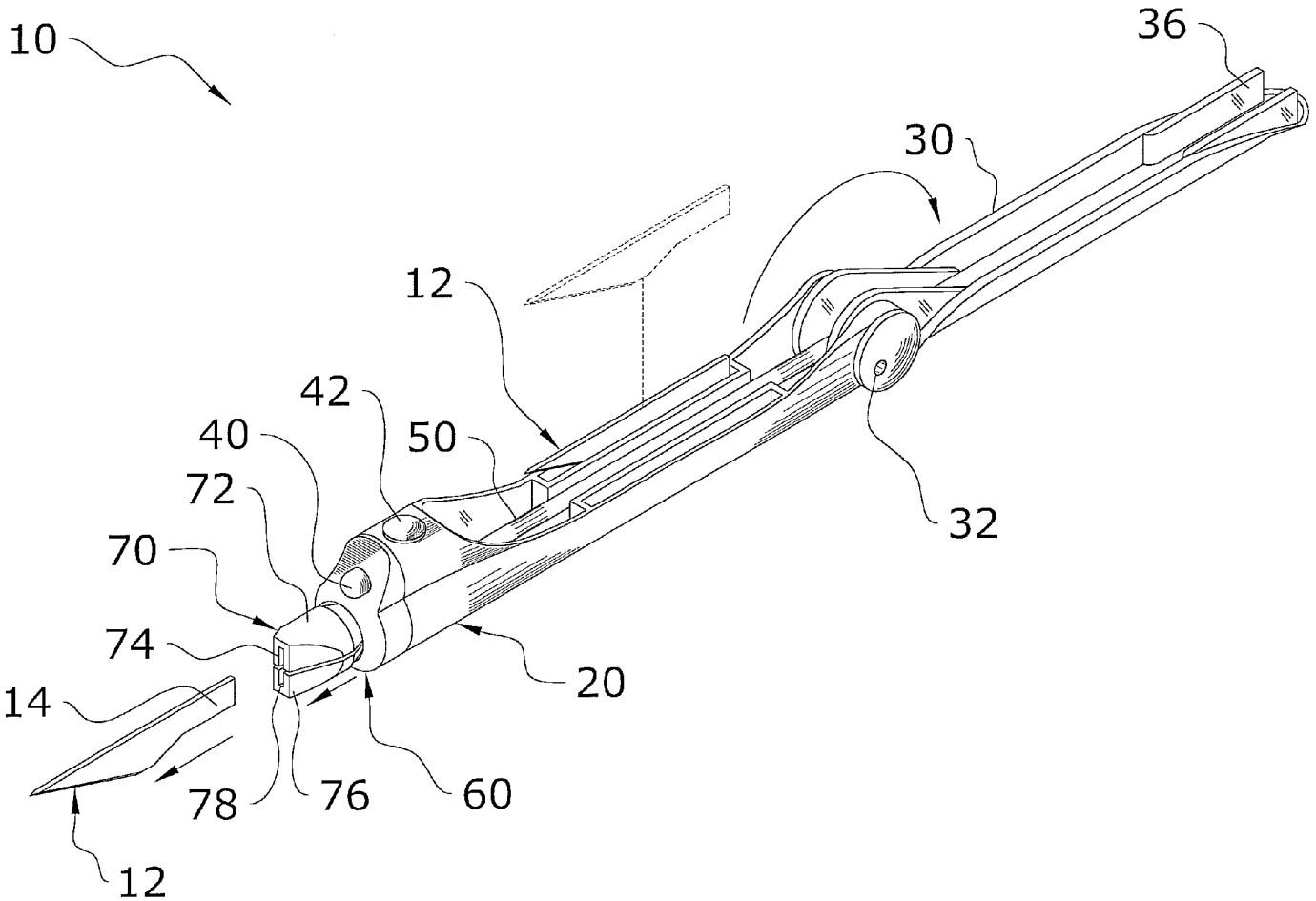
FIG. 2*c* is an upper perspective view of the lever member fully opened to release the blade from the collet.

The body 20 preferably includes at least one storage compartment to store a replacement blade 12 as best illustrates in FIGS. 2*b* and 2*c* of the drawings. The storage compartments 26 are preferably positioned on opposing interior sides of the body 20 with the shaft 50 passing between thereof. Each storage compartment is covered by the lever 30 when the lever 30 is in the closed position as illustrated in FIGS. 2*a* and 2*b* of the drawings.

Figure 3:
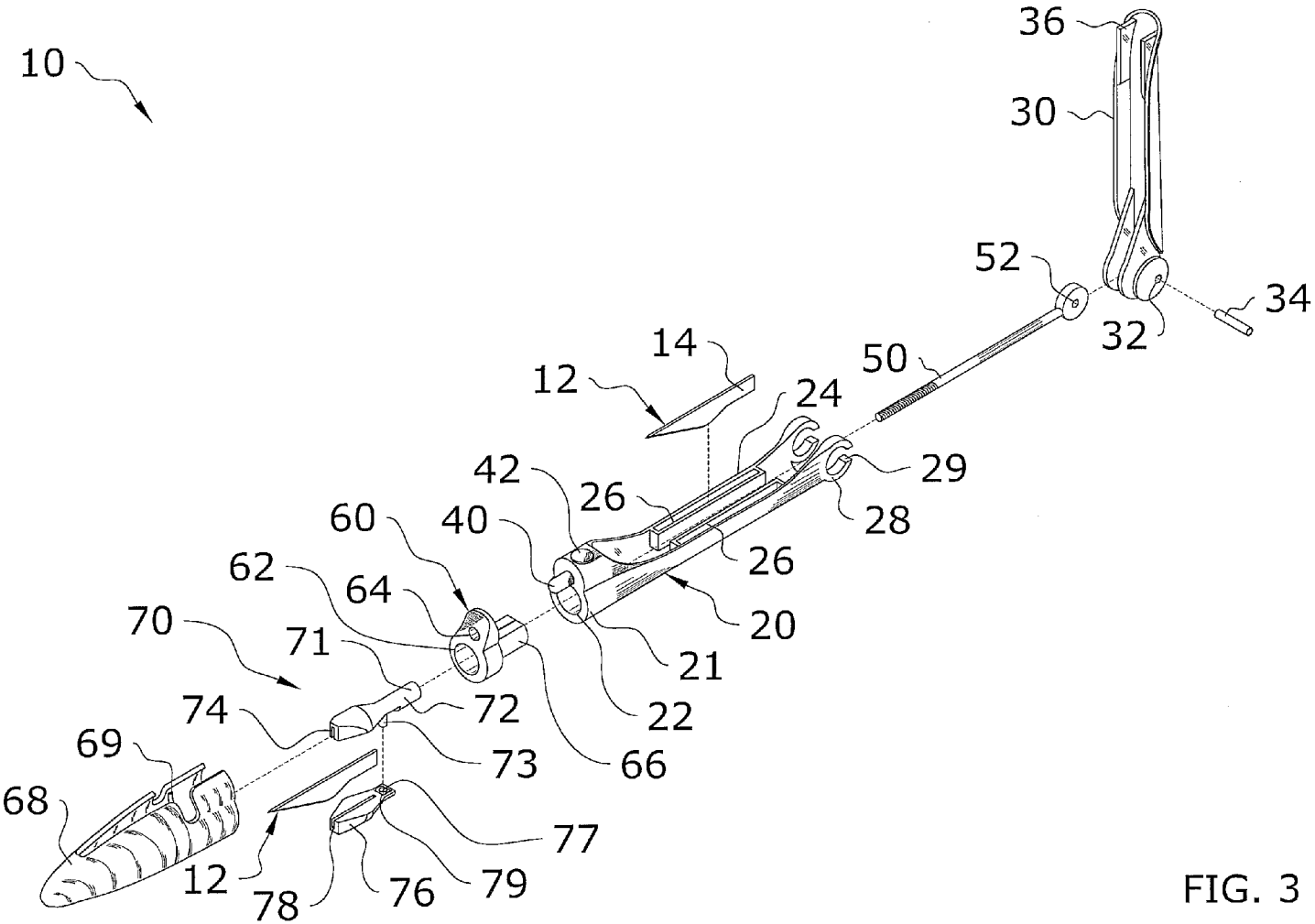
FIG. 3 is an exploded view of the preferred embodiment.
Figure 4:
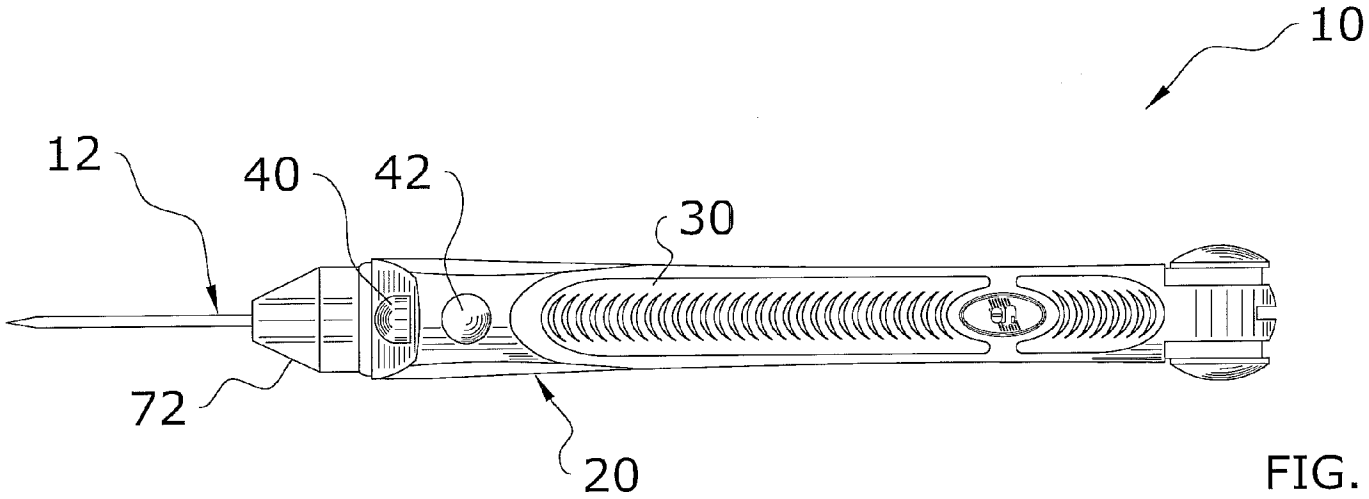
FIG. 4 is a bottom view of the preferred embodiment.

FIG. 3 illustrates wherein the body 20 includes a head member 60 having an extended portion 66 is attached to a first opening 22 within the body 20. As shown in FIG. 3, the head member 60 includes a front opening 62 for receiving the collet 70 and a light opening 64 for receiving the illuminating unit 40.

C. Lever

The lever 30 is pivotally connected to the body 20 at a first pivot point as shown in FIGS. 2*a* through 2*c* of the drawings. The lever 30 is preferably pivotally connected to the second end 28 of the body 20 opposite of the collet 70 as shown in FIGS. 1 through 2*c* of the drawings. The first pivot point has a first axis that is substantially transverse with respect to a longitudinal axis of the body 20.

The second end 28 of the body 20 preferably includes a pair of receiver members 29 that slidably receive hinge members of the lever 30 as shown in FIG. 3 of the drawings. The hinge members preferably are each comprised of a semi-rectangular structure with flanged portions. The receiver members 29 are comprised of a C-shaped structure with the opening narrower than the interior opening within the receiver members 29 to allow for rotation of the hinge members within the receiver members 29. The narrower opening within the receiver members 29 allows passage of the hinge members only when the semi-rectangular structure of the hinge members are longitudinally aligned with the openings.

FIG. 2*a* illustrates the lever 30 in the closed position to contract the collet 70 upon the blade 12 thereby preventing movement or release of the blade 12 from the collet 70. FIG. 2*c* illustrates the lever 30 in the open position to allow for release of the collet 70 and the blade 12 from the collet 70.

The lever 30 is preferably comprised of a molded plastic material. However, the lever 30 may be comprised of various other materials including but not limited to metal. The lever 30 preferably has a U-shaped cross sectional structure to provide for increased strength and stability during operation as illustrated in FIGS. 2*b* and 2*c* of the drawings.

As shown in FIGS. 1 through 5 of the drawings, the lever 30 is comprised of shape that when closed with respect to the body 20 creates an ergonomic shaped structure capable of being held within the hand of a user. The outer surface of the lever 30 preferably includes a plurality of U-shaped gripping members that assist in maintaining a user's grip during usage and operation of the present invention.

Figure 9:
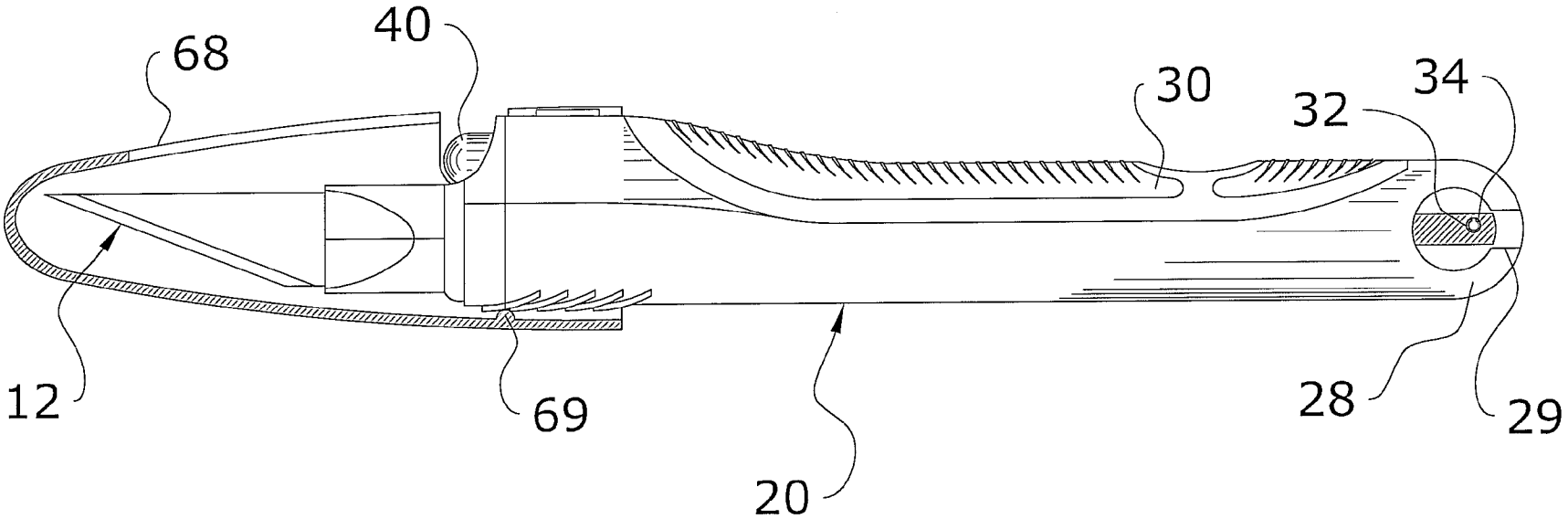
FIG. 9 is a side cutaway view of the preferred embodiment.

As shown in FIG. 9 of the drawings, a significant portion of the outer surface of the lever 30 is substantially parallel with respect to an opposite side of the body 20. The lever 30 is further formed to fit within the recessed portion 24 formed within the body 20 so that when the lever 30 is closed the lever 30 and the body 20 have a unitary appearance.

The lever 30 further preferably includes one or more guide members 36 opposite of the first pivot point to guide the lever 30 within the recessed portion 24 of the body 20 when entering the closed position. The guide members 36 preferably extend from the end portion of the lever 30 and extend into the interior of the body 20 when in the lever 30 is in the closed position. The guide members 36 provide for increased alignment of the lever 30 during closing, and stability after the lever 30 is closed to prevent side-to-side movements of the lever 30 during operation thereof.

The lever 30 includes an offset aperture 32 that extends through the lever 30 and substantially parallel to the first pivot point as shown in FIGS. 1 through 3 and 5. The offset aperture 32 receives an offset pin 34 that the shaft 50 pivotally connects to. The offset pin 34 may be comprised of any structure capable of pivotally supporting the shaft 50. The offset pin 34 preferably extends between two support portions extending from the lever 30 that support the hinge members as shown in FIGS. 2*b* and 2*c* of the drawings.

Figure 5:
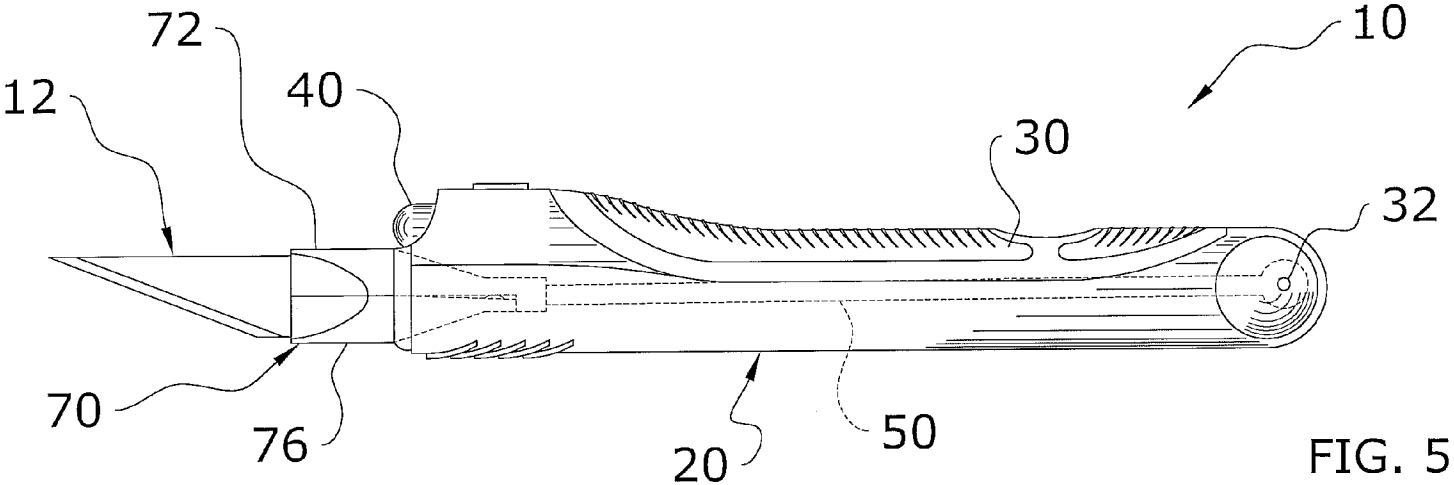
FIG. 5 is a side view of the preferred embodiment.
Figure 6:
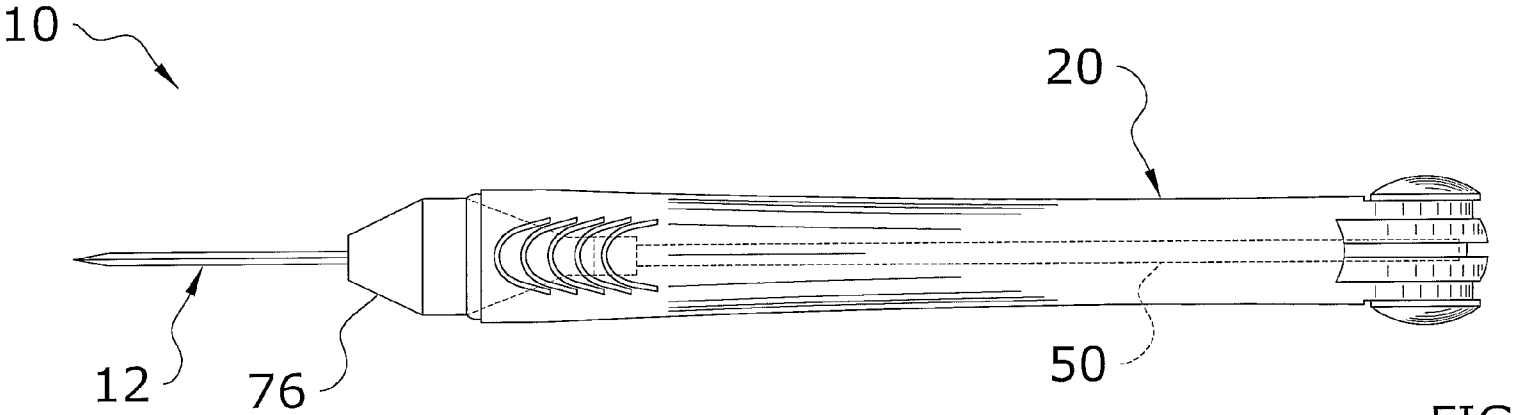
FIG. 6 is a top view of the preferred embodiment.
Figure 8:
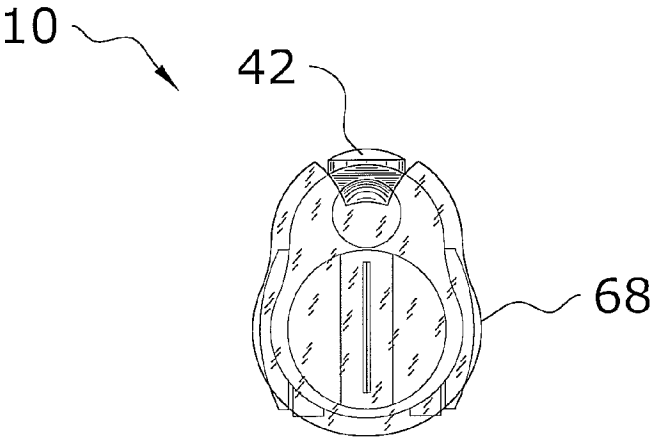
FIG. 8 is a front end view of the preferred embodiment.
Figure 7:
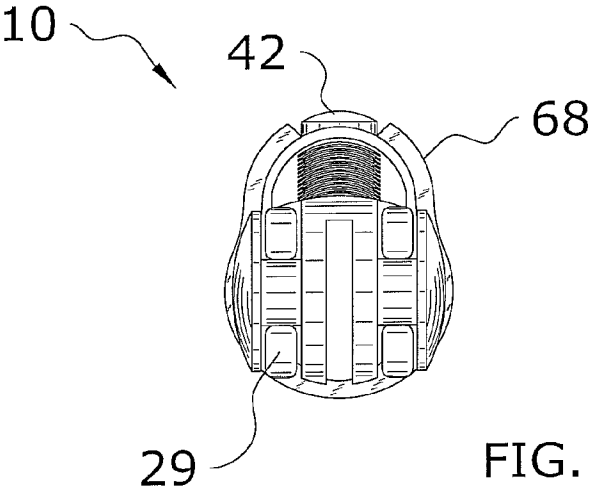
FIG. 7 is a rear end view of the preferred embodiment.

The offset aperture 32 is positioned away from collet 70 when the lever 30 is in the closed position as shown in FIG. 5 of the drawings. The offset aperture 32 is further positioned above or below the first pivot point when the lever 30 is in the closed position to provide a constant closing force to the lever 30 when in the closed position as shown in FIG. 5 of the drawings.

When the lever 30 is in the open position, the offset aperture 32 is positioned closer to the collet 70 thereby allowing the collet 70 to expand and release a blade 12 as shown in FIG. 2*c* of the drawings. When the lever 30 is in the open position, the shaft 50 is moved towards the collet 70 which results in the loosening of the collet 70 to release the blade 12.

D. Collet

A collet 70 is positioned within a front opening 62 of the body 20 to selectively receive, secure and release a blade 12. The collet 70 may be comprised of any structure capable of frictionally engaging a neck 14 of a blade 12 in a non-movable manner.

The collet 70 is movably connected to the first end 21 of the body 20. The collet 70 is preferably rotationally positioned within the front opening 62 of the body 20 so that when the lever 30 is in the open position, it allows for rotation of the collet 70 to achieve different blade angles and allows for adjustment of the collet 70 with respect to the shaft 50. The collet 70 is preferably comprised of a first member 72 having a first slot 74 and a second member 76 having a second slot 78 in opposition to one another. The first member 72 and the second member 76 are comprised of inwardly tapering structures received within a front opening 62 of the body 20. When the shaft 50 draws the collet 70 inwardly toward the body 20 the first member 72 and the second member 76 are contracted toward one another to frictionally retain the blade 12 within the collet 70.

The first member 72 preferably includes an extended member 71 having an interiorly threaded aperture that threadably engages an exteriorly threaded portion of the shaft 50. By rotating the collet 70 (which includes the first member 72), the extended member 71 is rotated upon the shaft 50 thereby causing the position of the first member 72 to move inwardly or outwardly with respect to the shaft 50 which allows for increased or decreased frictional engagement of the blade 12 respectively.

A guide pin 73 preferably extends from the first member 72 as best illustrated in FIG. 3 of the drawings. The guide pin 73 is received within a guide aperture 77 within the second member 76 as further shown in FIG. 3 of the drawings. The guide pin 73 retains the first member 72 connected to the second member 76 when positioned within the front opening 62 of the body 20. The guide aperture 77 is sufficiently larger than the guide pin 73 to allow for not only rotational movement but also pivotal movement of the guide pin 73 within the guide aperture 77.

In addition, the second member 76 preferably includes a cantilever portion 79 surrounding the guide aperture 77 that the first member 72 pivots upon with respect to the second member 76 as further shown in FIG. 3. The cantilever portion 79 is preferably comprised of a rounded configuration.

The first slot 74 and the second slot 78 form a receiver slot that receives the neck 14 of the blade 12 as shown in FIGS. 2*b* and 2*c* of the drawings. The receiver slot is sufficient in size to allow for receipt of the neck 14 of the blade 12 but prevents the main portion of the blade 12 from entering.

E. Blade

The blade 12 is removably secured within the collet 70 as shown in FIG. 2*a* of the drawings. The blade 12 may be comprised of various styles of blades used in hobby knives, utility knives and medical knives, and any other replaceable blade 12. The blade 12 typically has a neck 14 that is inserted within the receiver slot within the collet 70 for frictional engagement thereof in a non-movable manner.

F. Shaft

The shaft 50 is connected between the lever 30 and the collet 70 as best illustrated in FIGS. 2*c*, 3 and 5 of the drawings. The shaft 50 is connected to the lever 30 at the second pivot point, wherein the second pivot point is offset from the first pivot point as discussed previously. The end of the shaft 50 connected to the collet 70 is preferably threaded to allow for adjustment of the collet 70 and the shaft 50 with respect to one another. The connecting end 52 of the shaft 50 is preferably looped to receive the offset pin 34.

The second pivot point is closer to the first end 21 of the body 20 when the lever 30 is in the open position than when the lever 30 is in the closed position. When the lever 30 is in the closed position the shaft 50 applies tension to the collet 70 causing the collet 70 to frictionally engage the blade 12. When the lever 30 is in the open position the shaft 50 reduces tension to the collet 70 compared to the closed position allowing the blade 12 to be removed from the collet 70.

G. Illuminating Unit

The illuminating unit 40 is attached to the body 20 to apply light towards an area near the blade 12. The illuminating unit 40 includes a switch 42 electrically connected between a power source and a light. The power source is preferably comprised of a battery and the light is preferably comprised of a light-emitting-diode (LED). Various other lights may be utilized to construct the illuminating unit 40.

The LED extends through and from the light opening 64 within the body 20 directed towards the blade 12 to illuminate a work area. The switch 42 is attached to the first end 21 of the body 20 wherein the user may simultaneously grasp the body 20 and close the switch 42 thereby activating the LED.

H. Cap

A cap 68 is removably attached to the first end 21 of the body 20 and covering the blade 12. The cap 68 preferably includes an inner lip 69 that catchably engages with a transverse groove within the body 20. The cap 68 has a length sufficient to allow the blade 12 to remain within the collet 70 and is rigid enough to prevent injury to an individual. The cap 68 preferably has a tapered design corresponding to the body 20 and the shape of the blade 12.

The cap 68 is preferably translucent or semi-translucent to allow an individual to see that a blade 12 is attached within. A slot preferably extends through the cap 68 to allow for viewing of the blade 12 and to allow for expansion of the cap 68 for securing and removal of the cap 68 with respect to the body 20.

I. Operation of Preferred Embodiment

In use, the user opens the lever 30 thereby causing the collet 70 to extend outwardly from the body 20 and expand as shown in FIG. 2*c* of the drawings. A blade 12 is removed from one of the storage compartments 26 and the neck 14 portion of the blade 12 is inserted into the slots 74, 78 of the collet 70. The user then closes the lever 30 which causes the shaft 50 to apply tension to the collet 70 as shown in FIG. 2*a* of the drawings. When tension is applied to the collet 70, the collet 70 contracts upon the neck 14 of the blade 12 in a frictional engagement thereby preventing removal of the blade 12. If the blade 12 is loose or becomes loose during usage, the user is able to open the lever 30 and then rotate the collet 70 to draw the collet 70 inwardly towards the body 20 resulting in additional friction being applied to the blade 12 to retain the blade 12 within the collet 70.

When the lever 30 is in the closed position, the tension within the shaft 50 coupled with the offset pivot point on the lever 30 results in an inward closing force constantly applied to the lever 30 to prevent the lever 30 from opening. The closing force is present as long as there is tension within the shaft 50.

When the user needs to replace a blade 12, the user opens the lever 30 by grasping the lever 30 and pivoting it away from the body 20. As the lever 30 is rotated away from the body 20, the offset pivot point that the shaft 50 is connected to moves towards the first end 21 of the body 20 resulting in reduced tension within the shaft 50 (and preferably extending the collet 70 outwardly slightly from the body 20) thereby resulting in the loosening of the collet 70 around the neck 14 of the blade 12. The user is then able to remove the blade 12 from the collet 70 and then position a new blade 12 within the collet 70 with the above procedure repeated.

After a blade 12 is properly secured within the collet 70, the user is then able to utilize the present invention to cut various types of items. While grasping the body 20 with the lever 30 with their hand, the user can also depress the switch 42 resulting in the illumination of the work area prior to and/or during cutting. The user may remove the pressure from the switch 42 at anytime resulting in the termination of the illumination.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A knife system for efficiently replacing a blade, comprising:

a body having a first end and a second end;

a lever pivotally connected to said body at a first pivot point, wherein said lever has a closed position and an open position;

a collet movably connected to said first end of said body;

a blade removably secured within said collet; and a shaft connected between said lever and said collet;

wherein when said lever is in said closed position said collet frictionally engages said blade;

wherein when said lever is in said open position said collet has reduced frictional engagement of said blade thereby allowing said blade to be removed from said collet;

wherein said collet is comprised of a first member having a first slot and a second member having a second slot, wherein a neck of said blade removably extends within said first slot and said second slot;

a guide pin extending from said first member that is received within a guide aperture within said second member;

wherein said second member includes a cantilever portion surrounding said guide aperture, wherein said first member pivots upon said cantilever portion with respect to said second member.

2. The knife system of claim 1, including an illuminating unit attached to said body to apply light towards said blade.

3. The knife system of claim 2, wherein said illuminating unit includes a switch electrically connected between a power source and a light.

4. The knife system of claim 1, wherein said collet is rotatably positioned within said body.

5. The knife system of claim 1, wherein said collet includes an extended member having an interiorly threaded aperture that threadably engages an exteriorly threaded portion of said shaft.

6. The knife system of claim 1, wherein said first member and said second member are comprised of inwardly tapering structures received within a front opening of said body.

7. The knife system of claim 1, wherein said first member includes an extended member having an interiorly threaded aperture that threadably engages an exteriorly threaded portion of said shaft.

8. The knife system of claim 1, wherein said collet includes an extended member having an interiorly threaded aperture that threadably engages an exteriorly threaded portion of said shaft, wherein said collet is rotatably positioned within said body to allow for adjustment of said collet with respect to said shaft.

9. The knife system of claim 1, wherein said shaft is connected to said lever at a second pivot point, wherein said second pivot point is offset from said first pivot point.

10. The knife system of claim 9, wherein said second pivot point is closer to said first end of said body when said lever is in said open position than when said lever is in said closed position.

11. The knife system of claim 1, wherein said body includes at least one storage compartment to store a replacement blade.

12. The knife system of claim 11, wherein said at least one storage compartment is covered by said lever when said lever is in said closed position.

13. The knife system of claim 1, including a cap removably attached to said first end of said body and covering said blade.

14. The knife system of claim 1, wherein said lever is pivotally connected to said second end of said body, wherein said second end is opposite of said first end.

15. A knife system for efficiently replacing a blade, comprising:

a body having a first end and a second end;

a lever pivotally connected to said body at a first pivot point, wherein said lever has a closed position and an open position;

wherein said body includes at least one storage compartment to store a replacement blade, wherein said at least one storage compartment is covered by said lever when said lever is in said closed position;

wherein said lever is pivotally connected to said second end of said body, wherein said second end is opposite of said first end;

a collet movably connected to said first end of said body, wherein said collet is comprised of a first member having a first slot and a second member having a second slot, wherein a neck of said blade removably extends within said first slot and said second slot;

wherein said first member and said second member are comprised of inwardly tapering structures received within a front opening of said body;

wherein said collet is rotatably positioned within said front opening of said body;

wherein said first member includes an extended member having an interiorly threaded aperture that threadably engages an exteriorly threaded portion of said shaft;

a guide pin extending from said first member that is received within a guide aperture within said second member;

wherein said second member includes a cantilever portion surrounding said guide aperture, wherein said first member pivots upon said cantilever portion with respect to said second member;

a blade removably secured within said collet; and a shaft connected between said lever and said collet;

wherein said shaft is connected to said lever at a second pivot point, wherein said second pivot point is offset from said first pivot point;

wherein said second pivot point is closer to said first end of said body when said lever is in said open position than when said lever is in said closed position;

wherein when said lever is in said closed position said collet frictionally engages said blade;

wherein when said lever is in said open position said collet has reduced frictional engagement of said blade thereby allowing said blade to be removed from said collet.

16. The knife system of claim 15, including an illuminating unit attached to said body to apply light towards said blade, wherein said illuminating unit includes a switch electrically connected between a power source and a light.

17. The knife system of claim 15, including a cap removably attached to said first end of said body and covering said blade.

* * * * *